US006042344A

United States Patent [19]

Lifson

[11] Patent Number: 6,042,344

[45] Date of Patent: Mar. 28, 2000

[54] CONTROL OF SCROLL COMPRESSOR AT SHUTDOWN TO PREVENT UNPOWERED REVERSE ROTATION

[75] Inventor: Alexander Lifson, Manlius, N.Y.

[73] Assignee: Carrier Corporation, Farmington, Conn.

[21] Appl. No.: 09/114,461

[22] Filed: Jul. 13, 1998

[51] Int. Cl.[7] ..... F04B 49/00; F04B 23/00

[52] U.S. Cl. ..... 417/310; 417/440

[58] Field of Search ..... 417/310, 440

[56] References Cited

U.S. PATENT DOCUMENTS

| | | | |
|---|---|---|---|
| 4,762,469 | 8/1988 | Tlscher | 417/279 |
| 4,840,545 | 6/1989 | Moilanen | 417/301 |
| 5,607,288 | 3/1997 | Wallis et al. | 417/310 |
| 5,803,716 | 9/1998 | Wallis et al. | 417/310 |
| 5,897,299 | 4/1999 | Fukunaga | 417/316 |

FOREIGN PATENT DOCUMENTS

| | | | |
|---|---|---|---|
| 403092592 | 4/1991 | Japan | 417/310 |

*Primary Examiner*—William Doerrler
*Attorney, Agent, or Firm*—Howard & Howard

[57] ABSTRACT

A unique method of operating a scroll compressor includes the steps of opening a capacity modulation unloader valve slightly before shutdown of the scroll compressor. By opening the unloader valve, the occurrence of unpowered reverse rotation is reduced or eliminated. Most preferably, the unloader valve communicates an economizer line to a suction inlet line.

10 Claims, 1 Drawing Sheet

CONTROL OF SCROLL COMPRESSOR AT SHUTDOWN TO PREVENT UNPOWERED REVERSE ROTATION

BACKGROUND OF THE INVENTION

This application relates to a unique method of controlling an unloader valve in a scroll compressor at shutdown to prevent unpowered reverse rotation.

Scroll compressors are becoming widely utilized in air conditioning and refrigerant applications. However, there are still design challenges facing scroll compressor designers. One persistent challenge with scroll compressor operation is unpowered reverse rotation at shutdown.

As known, scroll compressors consist of two interfitting and generally spiral wraps. The interfitting wraps define compression pressure pockets. One of the wraps usually orbits relative to the other and the size of the compression pockets change to compress an entrapped fluid. The orbiting scroll is driven by an electric motor via a shaft. On shutdown, when the power is turned off, there is no torque applied by the motor and the orbiting scroll can start rotating in reverse, as the high pressure fluid from the discharge line and compressor discharge muffler is expanded back through the compression elements into the compressor suction. After the pressure is equalized, or nearly equalized, the reverse rotation is stopped. Similarly, unpowered reverse rotation can occur if the fluid is expanded from an economizer line into the compressor suction through compression elements. This reverse rotation can create unwanted noise, and further can create other operational problems.

Thus, the prior art has attempted to reduce or eliminate the occurrence of unpowered reverse rotation. For the most part, the solutions to the unpowered reverse rotation problem have included the application of additional elements into the scroll compressor. One of the prior solutions was to use an internal compressor check valve which would close when high pressure fluid from the discharge line would rush back into the compressor after shutdown. The check valve blocked the high pressure fluid from entering the wraps and thus minimized the duration, or eliminated, unpowered reverse rotation. However, for compressors with an economizer circuit, the high pressure fluid can enter the compressor upstream of the check valve and still cause reverse rotation. Thus even the inclusion of additional costly internal elements as often used in the past would have not prevented unpowered reverse rotation of a scroll compressor with an economizer circuit.

Thus, it would be desirable to find a solution to the problem of unpowered reverse rotation that does not require any additional components to be added into the scroll compressor.

SUMMARY OF THE INVENTION

In a disclosed embodiment of this invention, a scroll compressor is operated by opening an unloader by-pass valve shortly before, or at, shutdown of the scroll compressor. By opening the unloader by-pass valve, the entrapped fluid at high pressure is short circuited directly to the suction line by-passing the compression elements. Unpowered reverse rotation is thus reduced or eliminated. In one preferred embodiment of this invention, the unloader valve is in communication with an economizer line and a suction inlet line. Economizer circuits are known compressor features wherein a supplemental inlet fluid is injected into the compression chambers at an intermediate compression point. An economizer line directs fluid at a pressure which significantly exceeds the suction pressure into the compression chamber. Thus, due to the significant volume of the economizer line and its associated components, the high pressure vapor from the economizer line expanding through scroll compressor elements can drive the orbiting scroll in reverse on shutdown.

By opening an unloader valve between the economizer line and the suction line, on or shortly before shutdown the high pressure fluid is directed into the suction line, thus, bypassing scroll compressor wraps. Thus, any unpowered reverse rotation which would have been caused by high pressure vapor in the economizer line is eliminated. It should be noted that this invention can be utilized on its own, or in addition to other ways of reducing or eliminating unpowered reverse rotation.

It should also be noted that the placement of an unloader valve between the economizer line and the suction inlet line is itself inventive as it provides capacity modulation of scroll compressor and the subject of a co-pending patent application entitled "Unloader Valve Between Economizer and Suction Line" which was filed on even date herewith, assigned Ser. No. 09/114,395, and owned by the assignee of this application. Another application of interest is Ser. No. 08/986,447 filed May 12, 1997 and entitled "Pulsed Flow for Capacity Control".

In other features of this invention, the system is provided with a control for both the electric motor for the scroll compressor and the unloader valve. The unloader valve is opened at a time approximately five seconds before shutdown of the motor. In this way, the problem of unpowered reverse rotation is reduced or eliminated.

These and other features of the present invention can be best understood from the following specification and drawings, the following of which is a brief description.

BRIEF DESCRIPTION OF THE DRAWING

The sole FIGURE is a schematic view of a scroll compressor system incorporating the present invention.

DETAILED DESCRIPTION OF A PREFERRED EMBODIMENT

Figure 1:
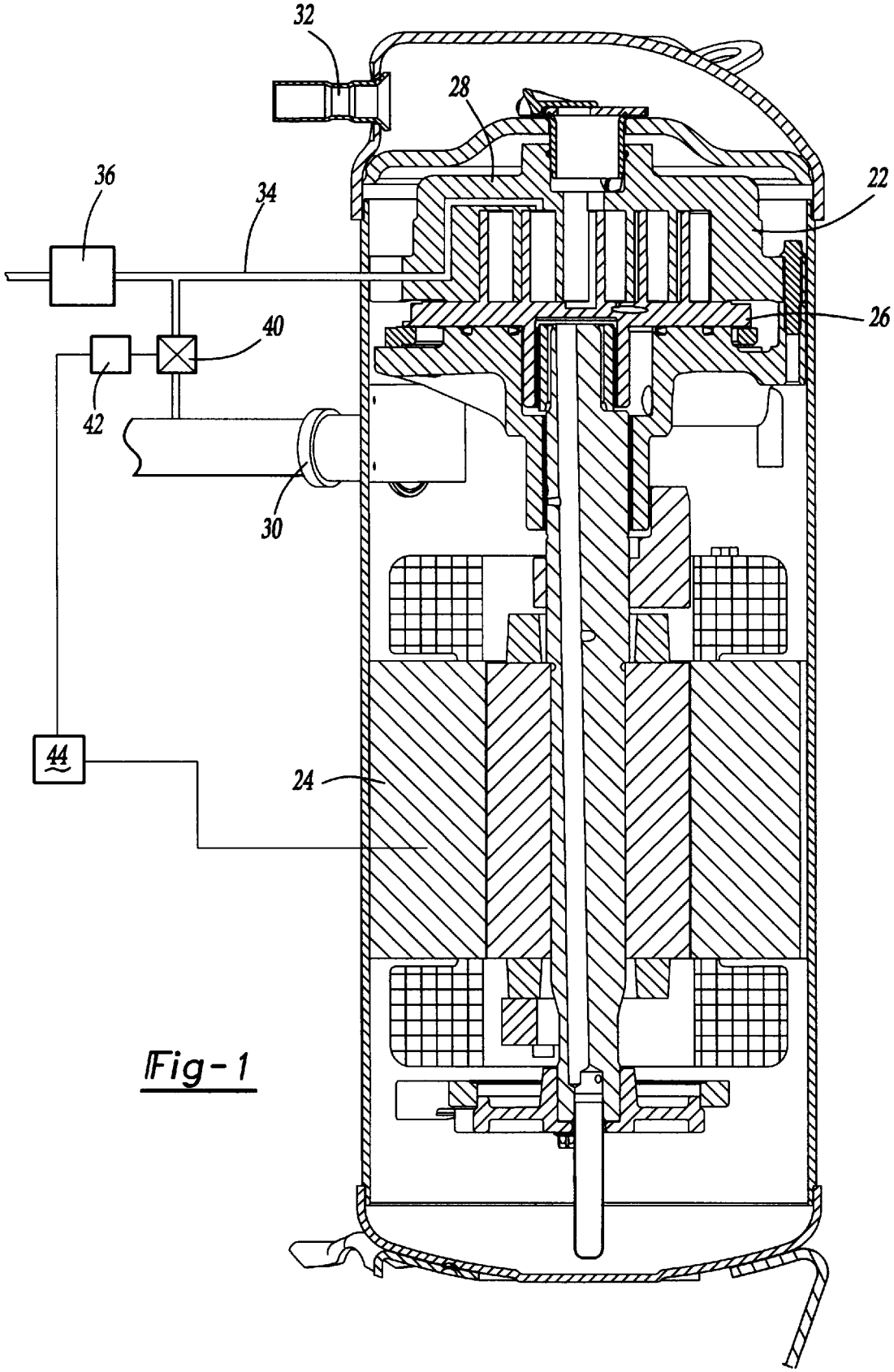

A scroll compressor system 20 is illustrated in FIG. 1 incorporating a pump unit 22, a motor 24 driving an orbiting scroll 26, and a non-orbiting scroll 28. As known, the two scroll members include wraps which interfit to define compression pockets. The compression pockets trap and compress a refrigerant. At shutdown, the high pressure refrigerant in the economizer or discharge line can drive the orbiting scroll in a reverse direction from the direction through which it is typically driven. This reverse rotation can be noisy and undesirable.

The scroll compressor 20 includes a suction line 30 for supplying refrigerant to pump unit 22 for compression, and a discharge line 32 directing refrigerant to downstream elements in a refrigerant system. An economizer line 34 supplies an economizer fluid to the scroll compressor. As known, an economizer line directs fluid to an intermediate point in the compression cycle. An economizer portion of heat exchanger 36 is shown schematically. An economizer circuit is utilized to increase the overall efficiency and capacity of the refrigerant system.

However, at shutdown, the presence of the economizer inlet line 34 can create further problems with regard to unpowered reverse rotation. The pressure in the economizer line 34 significantly exceeds the pressure in the suction line 30, and thus reverse rotation may occur as vapor at high pressure at the economizer line 34 expands through the compression elements, if unloader valve 40 is closed.

Thus, according to this invention, an unloader valve 40 and associated communication passage 38, which directly communicates the economizer line 34 to the suction inlet line 30 can be opened at, or shortly before, shutdown. Unloader valves for capacity modulation are known in scroll compressor application. As known, an unloader valve typically communicates a compressed fluid back to suction when capacity modulation is desired. The unloader valve is selectively open to achieve capacity modulation when the motor is operating normally. The present invention uses this unloader valve to also address reverse rotation. However, the positioning of an unloader valve to communicate the economizer line to the suction line is novel. This novel placement of an unloader valve is detailed in a co-pending patent application Ser. No. 09/114,395, filed on even date herewith, and entitled "Unloader Valve Between Economizer and Suction Line."

As to this application, it is the unique method of operating an unloader valve shortly after, at, or just before shutdown to prevent unpowered reverse rotation which is inventive.

Control 42 for the unloader valve 40 communicates with a control 44 for the overall system. Control 44 communicates with motor 24. In a preferred embodiment, the control 44 opens unloader valve 40 to communicate the economizer line 34 to suction line 30 just before shutdown of the motor 24. Preferably, the unloader valve is opened less than five seconds before shutdown of the scroll compressor. Most preferably, the time period may be one or two seconds. Also, the opening can occur within a few seconds after shutdown. As an example, less than one second after shutdown.

It is also possible to open the unloader valve at the same time the motor is shut down. It is also possible to have a built-in delay in the motor shutdown. In these cases the use of controllers 42 and/or 44 can be eliminated.

When the control 44 determines that the motor 24 will be shut down, it opens the unloader valve 40, and then shuts down the motor 24. By opening the unloader valve 40, the pressure in the economizer line 34 and the suction line 30 will be equalized. Thus, vapor from the economizer line will not expand into the scroll compressor wraps and unpowered reverse rotation will be eliminated.

In addition, any high pressure vapor from the discharge line and high pressure vapor trapped in the scroll compressor wraps, and between the scroll compressor wraps and the discharge line will also be by-passed into the economizer line and then directly into suction line. This further minimizes the possibility of unpowered reverse rotation.

It should be noted that the method of this invention will be utilized even when the economizer system 36 is not functioning or not present at all and only bypass operation is desired. The economizer cycle is typically utilized only when high capacity operation is desired. Even so, it is preferred that the unloader valve 40 be opened whether the economizer cycle is operating or not, as the pressure in line 34 exceeds the pressure in the suction line 30 even when the economizer circuit 36 is not operating.

It is also preferred that the unloader value 40 is open even if no economizer circuit is present at all. In this case high pressure fluid inside the scroll compression element and line 34 is directed into compressor suction, by-passing a portion of the scroll compression elements. Thus, also minimizing possibility of unpowered reverse rotation.

Preferred embodiments of this invention have been disclosed; however, a worker of ordinary skill in the art would recognize that certain modifications come within the scope of this invention. For that reason, the following claims should be studied to determine the true scope and content of this invention.

I claim:

1. A method of operating a scroll compressor comprising the steps of:

(1) providing a scroll compressor including an orbiting scroll and a second scroll, both said orbiting and second scrolls having spiral wraps which interfit to define compression pockets, a suction line for supplying a refrigerant to be compressed to said scroll compressor, a motor for driving said orbiting scroll relative to said second scroll, and an electrically controlled unloader valve to communicate said suction line to a point in a refrigerant cycle at which said refrigerant is at a higher pressure than said suction line a second line communicating with a compression pocket at said point in a refrigerant cycle, and said unloader valve selectively communicating said suction line to said second line, said unloader valve being selectively operated during operation of said compressor to unload said compressor during normal operation of said motor;

(2) running said scroll compressor by driving said motor;

(3) determining that said motor will be stopped; and (4) opening said unloader valve once the determination of step (3) has been made, at least a few seconds before shutdown of said motor, and then shutting down said motor.

2. A method as recited in claim 1, wherein said unloader valve communicates an economizer line to a portion of said compressor at suction pressure, and wherein refrigerant is periodically injected through said economizer line into said compressor with said unloader valve closed when a determination has been made that economizer operation is desirable.

3. A method as recited in claim 2, wherein said opening of said unloader valve occurs whether an economizer system is operating or not operating.

4. A method as recited in claim 1, wherein said unloader valve is opened less than five seconds before shutdown of said motor.

5. A method of operating a scroll compressor comprising the steps of:

(1) providing a scroll compressor including an orbiting scroll and a second scroll, both said orbiting and second scrolls having spiral wraps which interfit to define compression pockets, a suction line for supplying a refrigerant to be compressed to said scroll compressor, a motor for driving said orbiting scroll relative to said second scroll, and an electrically controlled unloader valve to communicate an economizer line to a portion of said compressor which is at suction pressure;

(2) running said scroll compressor by driving said motor;

(3) operating said compressor and selectively injecting a refrigerant through said economizer line into said portion of said compressor with said electrically controlled unloader valve being closed when a determination is made that economizer operation is desirable;

(4) determining that said motor will be stopped;

(5) opening said unloader valve once the determination of step (3) has been made, before said motor is shut down;

(6) then stopping said motor.

6. A method as set forth in claim 5, wherein the opening of said unloader valve is less than five seconds before the stopping of the motor in step (6).

7. A method as set forth in claim 5, wherein said unloader valve is opened independently of whether said economizer line is operational.

8. A scroll compressor comprising:

an orbiting scroll having a spiral wrap;

a second scroll having a spiral wrap interfitting with said spiral wrap of said orbiting scroll;

a motor for driving said orbiting scroll relative to said second scroll;

a suction line for supplying a refrigerant to said scroll compressor, an economizer line for supplying an economizer fluid to said scroll compressor;

an unloader valve for communicating an intermediate compression chamber to a portion of said compressor which is at suction pressure; and a control operable to determine when said motor will be shut down, and open said unloader valve to communicate an intermediate compression chamber to said suction line when a determination has been made that said motor will be shut down.

9. A scroll compressor as recited in claim 8, wherein said control opens said unloader valve a few seconds before said motor is shut down.

10. A scroll compressor as recited in claim 8, wherein said economizer line is utilized to periodically inject refrigerant into said compressor when a determination is made that economizer operation is desirable.

* * * * *